United States Patent [19]

Harkins

[11] Patent Number: 4,573,298

[45] Date of Patent: Mar. 4, 1986

[54] BUILDING INSULATION SYSTEM

[75] Inventor: Daniel J. Harkins, Norfolk, Nebr.

[73] Assignee: Thermal Design, Inc., Norfolk, Nebr.

[21] Appl. No.: 607,297

[22] Filed: May 4, 1984

Related U.S. Application Data

[63] Continuation-in-part of Ser. No. 246,209, Mar. 23, 1981, Pat. No. 4,446,664.

[51] Int. Cl.[4] ..... E04B 1/74

[52] U.S. Cl. ..... 52/404; 52/743; 52/748

[58] Field of Search ..... 52/404, 405, 406, 407, 52/410, 743, 748

[56] References Cited

U.S. PATENT DOCUMENTS

| | | | |
|---|---|---|---|
| 2,028,253 | 1/1936 | Spafford | 52/406 |
| 2,335,968 | 12/1943 | Sawtell | 52/407 |
| 2,896,278 | 7/1959 | Sawtell | 52/743 |
| 3,969,863 | 7/1976 | Alderman | 52/90 |
| 4,047,346 | 9/1977 | Alderman | 52/80 |
| 4,069,636 | 1/1978 | Kessler | 52/712 |
| 4,075,806 | 2/1978 | Alderman | 52/407 |
| 4,075,807 | 2/1978 | Alderman | 52/90 |
| 4,078,355 | 3/1978 | Clemensen | 52/665 |
| 4,125,982 | 11/1978 | Ward | 52/743 |
| 4,147,003 | 4/1979 | Alderman | 52/404 |
| 4,172,345 | 10/1979 | Alderman | 52/406 |
| 4,233,791 | 11/1980 | Kuhl et al. | 52/743 |
| 4,303,713 | 12/1981 | Clemensen et al. | 52/404 |
| 4,329,823 | 5/1982 | Simpson | 52/410 |
| 4,361,993 | 12/1982 | Simpson | 52/410 |
| 4,391,075 | 7/1983 | Musgrave | 52/404 |
| 4,434,601 | 3/1984 | Zellmer | 52/407 |
| 4,446,664 | 5/1984 | Harkins | 52/404 |
| 4,472,920 | 9/1984 | Simpson | 52/741 |

OTHER PUBLICATIONS

Caddy, Strap Hanger Clamps, single page, Product Sheet.

Caddy, Vertical Flange Clamps, single page, Product Sheet.

*Primary Examiner*—James L. Ridgill, Jr.

*Attorney, Agent, or Firm*—Zarley, McKee, Thomte, Voorhees & Sease

[57] ABSTRACT

A system for insulating a building roof structure having a plurality of secondary structural members extended longitudinally between a pair of oppositely situated primary structural members includes a plurality of spaced-apart parallel support bands extended transversely across the undersides of the secondary structural members, a suspension sheet supported on said bands and extending longitudinally between a pair of primary structural members and transversely across a plurality of the secondary structural members, thermal insulation material supported on the suspension sheet and band fastener means for connecting the bands to the secondary structural members, the suspension sheet being continuous but for the passage of the band fastener means therethrough.

The invention is also directed to a plurality of band hangers with coacting fastener means to facilitate connection of the bands to the secondary structural members. A method for the retrofit installation of blanket type insulation in a roof structure of an existing building is described as well as a system for insulating the wall structure of a building.

23 Claims, 37 Drawing Figures

BUILDING INSULATION SYSTEM

CROSS REFERENCE TO RELATED APPLICATION

This is a continuation-in-part of copending patent application Ser. No. 246,209 which was filed Mar. 23, 1981 now U.S. Pat. No. 4,446,664, issued May 8, 1984.

BACKGROUND OF THE INVENTION

The present invention relates generally to roof and wall insulation systems and more particularly to an improved system and method for insulating both existing buildings and new construction.

Metal buildings of the type conventionally used for barns, workshops and numerous industrial applications have many advantages over wood buildings, including ease of construction and low maintenance costs. Because of the rising costs of energy in recent years, it has become increasingly necessary to provide more efficient methods of insulation for metal buildings.

Conventionally, insulation for the roof of a metal building is provided by placing a layer of rolled insulation across the top of the purlins or rafters of a building prior to installing the roof. The roof is then attached to the purlins through the insulation. A problem with this method of insulation has been that the insulation must be tightly compressed between the sheeting and purlins. Compression of the insulation causes it to become less efficient at reducing heat transfer and as a result, there is a significant heat loss from the building roof in the area of the purlins. Additionally, the insulation which is rolled out over the purlins must be of limited thickness even in the area between the purlins due to the fact that it must be sufficiently compressed in the area above the purlins to allow attachment of the roof sheeting. Attempts have been made to improve the heat loss characteristics of a roof by installing pan insulation which fills the entire void between the purlins and the roof sheeting. However, this pan insulation must be supported at its lower surface. Conventional systems available for providing lower surface support of the pan insulation are time consuming to install and quite expensive. Another major problem with existing methods of insulating metal buildings is that heat is lost through the metal roof purlins by conduction to the exterior surface and therafter through radiation. The purlins are thus cooled to a temperature much lower than that of the air in the building which causes condensation from water vapor in the air to form on the purlin surfaces. Conventional methods of insulating do not provide a positive vapor barrier below the purlins and therefore condensation problems arise.

It can, therefore, be seen that a need exists for a support system which will support insulation placed between purlins which also may function to provide a positive vapor barrier below the roof purlins. To be cost effective the system must be easily installed and must have low material and labor costs.

Whereas the insulation system disclosed in applicant's copending patent application Ser. No. 246,209 represents a significant advance in the art, certain shortcomings have since been resolved. The fastening of the bands by many self-tapping screw fasteners, for example, is a slow, difficult task in large roof structures. Accordingly, there is a need for a system and method of quickly and easily supporting elongated bands on any type of roof structure. There is also a need for a similar insulation system for building walls.

SUMMARY OF THE INVENTION

The present invention utilizes a grid-work or series of parallel steel banding material to support a vapor barrier sheet, which in turn supports insulation material placed between secondary structural members of a building roof or wall.

Accordingly, it is a primary object of the present invention to provide an improved insulation system for use in buildings of all types.

It is a further object of the present invention to provide an insulation system having a separate continuous vapor barrier.

It is a further object of the present invention to provide an insulation system which may be used in new construction or existing structures.

It is a more specific object of the present invention to provide an insulation system which is adaptable to preengineered steel builings, bar-joist roof construction, wood beam or truss systems, wood or metal framed walls, and other types of construction.

It is a further object of the present invention to provide an insulation system which may be used for a high "R" factor insulation system.

It is a further object of the present invention to provide an insulation system wherein the material/labor ratio is very high.

It is a further object of the present invention to provide an insulation system which is inexpensive to install.

It is a further object of the present invention to provide an insulation system which may be used with or without a vapor barrier sheet.

It is a further object of the present invention to provide an insulation system which may be used with a fire retardant vapor barrier material.

It is a further object of the present invention to provide an insulation system which may be used with roll or batt insulation, including fiberglass and rock wool insulation material.

It is a further object of the present invention to provide an insulation system which may utilize blown-in insulation of various types.

It is a further object of the present invention to provide an insulation system which requires no special installation tools.

It is a further object of the present invention to provide an insulation system which is installed with the suspension system and vapor barrier at the interior side of the secondary structural members.

It is a further object of the present invention to provide an insulation system which is aesthetically pleasing in appearance.

It is a further object of the present invention to provide an insulation system which may be used as an exposed finished ceiling.

It is a further object of the present invention to provide an insulation system which may be installed in very cold temperatures without splitting or cracking of the suspension material.

It is a further object of the present invention to provide an insulation system which may be installed under windier conditions than conventional steel building insulation.

It is a further object of the present invention to provide an insulation system which has materials which are extremely tough and durable and resistant to most chemical salts and acids.

It is a further object of the present invention to provide an insulation system whch may be fitted into existing building at lower costs than conventional systems.

It is a further object of the present invention to provide an insulation system which may be installed either before or after the roof is installed.

It is a further object of the present invention to provide an insulation system which may be installed by construction crews without any special training or experience.

It is a further object of the present invention to provide an insulation system which provides a light reflective lower surface.

It is a further object of the present invention to provide an insulation system in which roof leaks can be easily detected and located for ease of repair.

It is a further object of the present invention to provide an insulation system with a minimum of seams in the installed vapor barrier material.

It is a further object of the present invention to provide an insulation system which eliminates the lamination process required to laminate sheets of vapor barrier material to fiberglass insulation.

It is a further object of the present invention to provide an insulation system which does not obstruct the bottom side of the roof structural members and interfere with attachment of mechanical and electrical apparatus.

It is a further object of the present invention to provide an insulation system which is also adaptable for use in building walls.

It is a further object of the present invention to provide an insulation system with an air film between the vapor barrier and the insulation.

A further object is to suspend the elongated bands from secondary structural members by the use of a plurality of band hangers which may be quickly and easily fit onto the secondary structural members with no drilling or machining being required.

A further object is to provide an insulation system using a band support system which accommodates the use of bands of minimum width.

It is a further object of the invention to provide a method for the retrofit installation of blanket type insulation in existing construction.

Finally, it is an object of the invention to provide an insulation system whereby the walls of a building may be easily, effectively and inexpensively insulated.

DESCRIPTION OF THE PREFERRED EMBODIMENT

Whereas the building insulation system of the present invention is adapted for use with any type of roof or wall structures, it will be first described in connection with a metal building.

Figure 1:
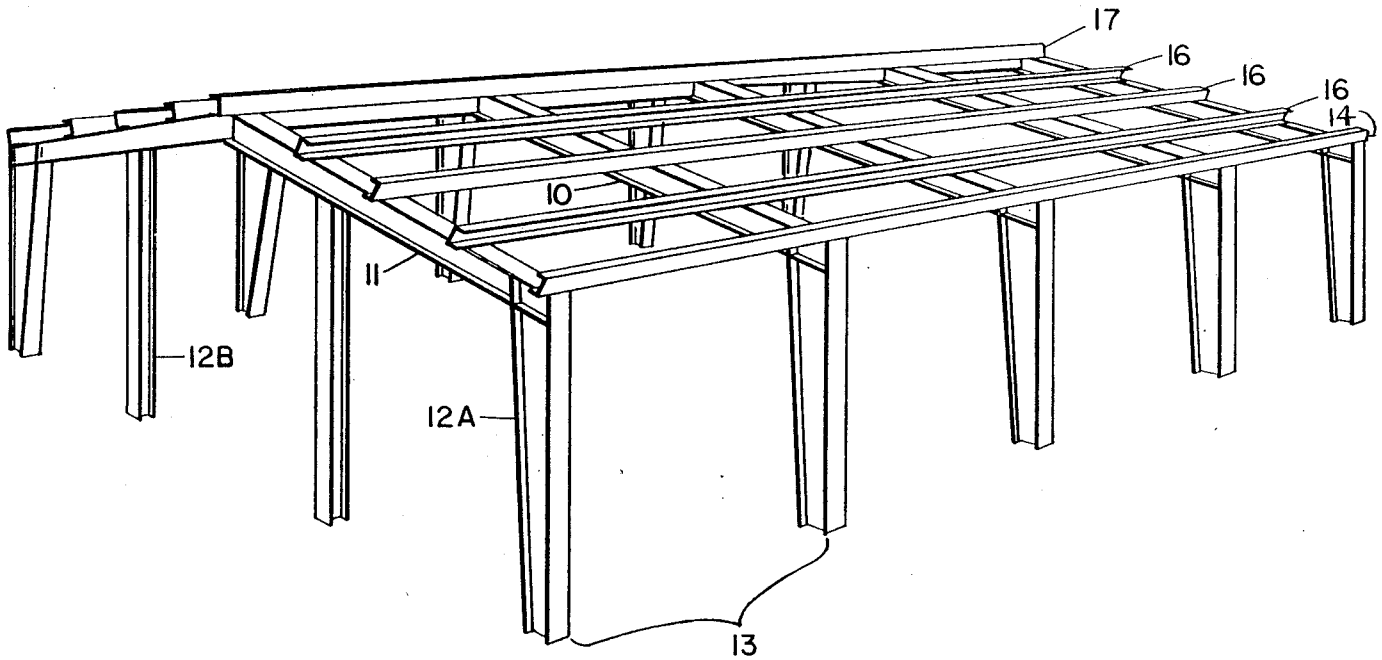
FIG. 1 is a perspective view of a typical metal building structure.
Figure 4:
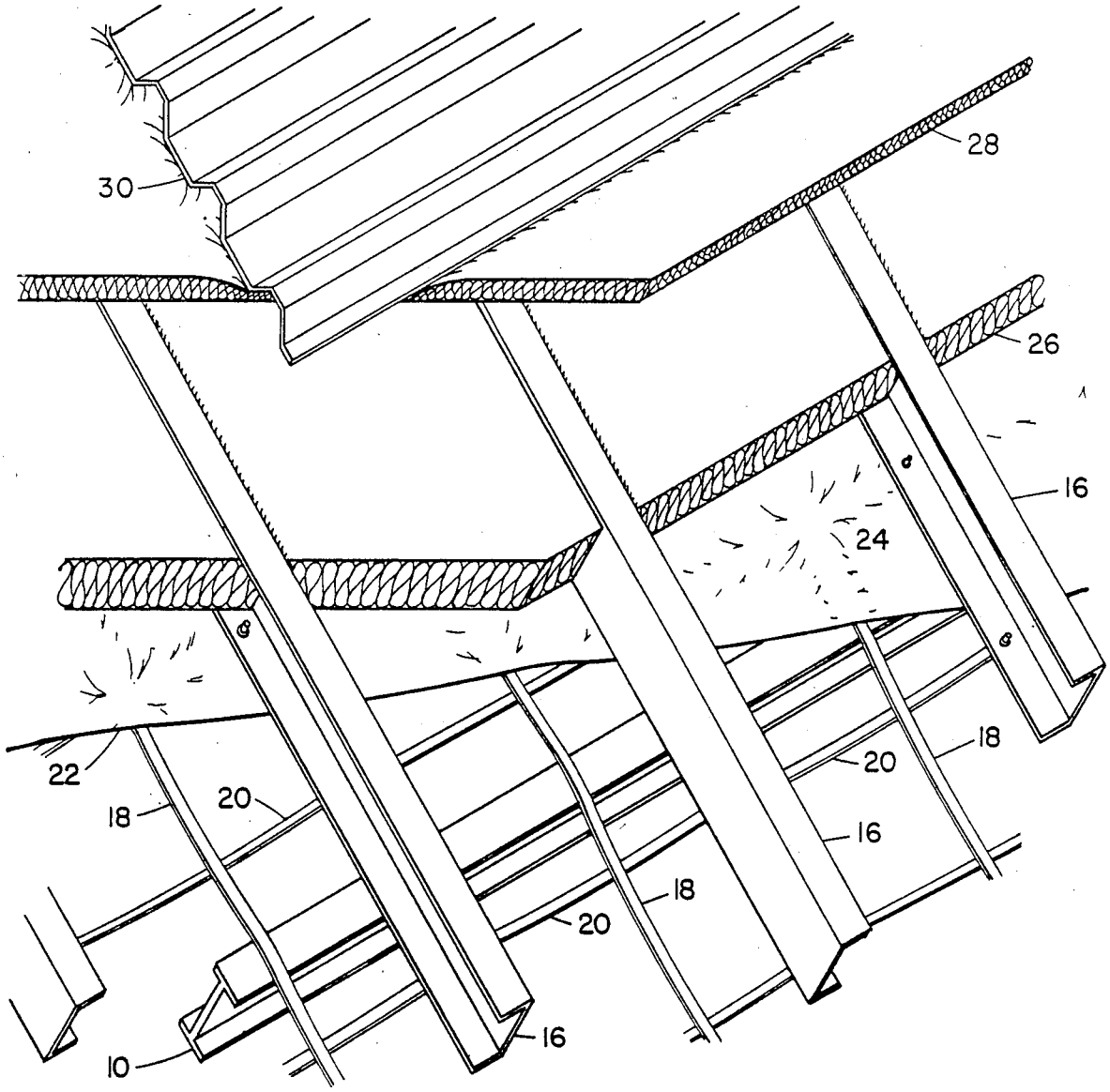
FIG. 4 is a cut-away perspective view showing sheet roofing insulation material, support sheet and support band grid-work and fastners.
Figure 5:
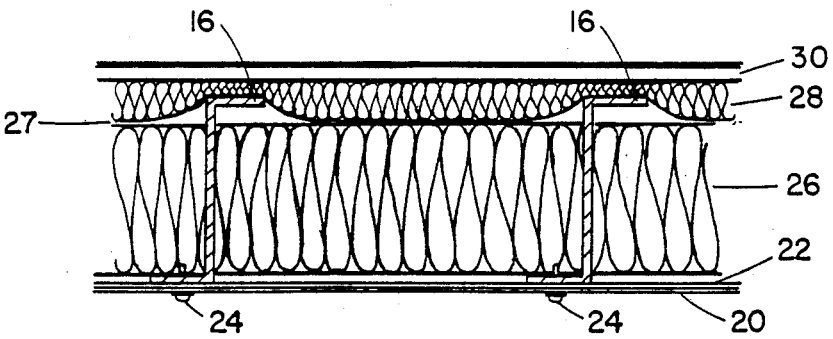
FIG. 5 is a detail elevation view showing "Z" purlins with double insulation.

The structural members of a typical metal building are shown in FIG. 1. It can be seen that vertical support for the roof is provided by rafter columns 12 positioned along the side walls of the building, end wall corner columns 12A, positioned at the corners of the building, and end wall columns 12B, positioned in the end walls of the building. Rafters 10, positioned at the top of the columns 12, 12A, and 12B span the building transversely creating a series of open spaces between rafters 10, commonly referred to as "bays" 13 in the construction arts. Eave struts 14 positioned at the end of the rafters 10, run the length of the building wall and provide lateral support between columns 12, 12A. Purlins 16, attached to the upper surface of the rafters 10, are placed in spaced parallel arrangement and run the length of the building between end wall rafters 11. Both "C" shaped and "Z" shaped purlins 16, as shown in FIGS. 4 and 5 respectively, are commonly used in the construction arts. Both types of purlins 16, as well as bar-joists (not shown) which are sometimes used instead of purlins, are compatible with the method and apparatus of the present invention.

Figure 2:
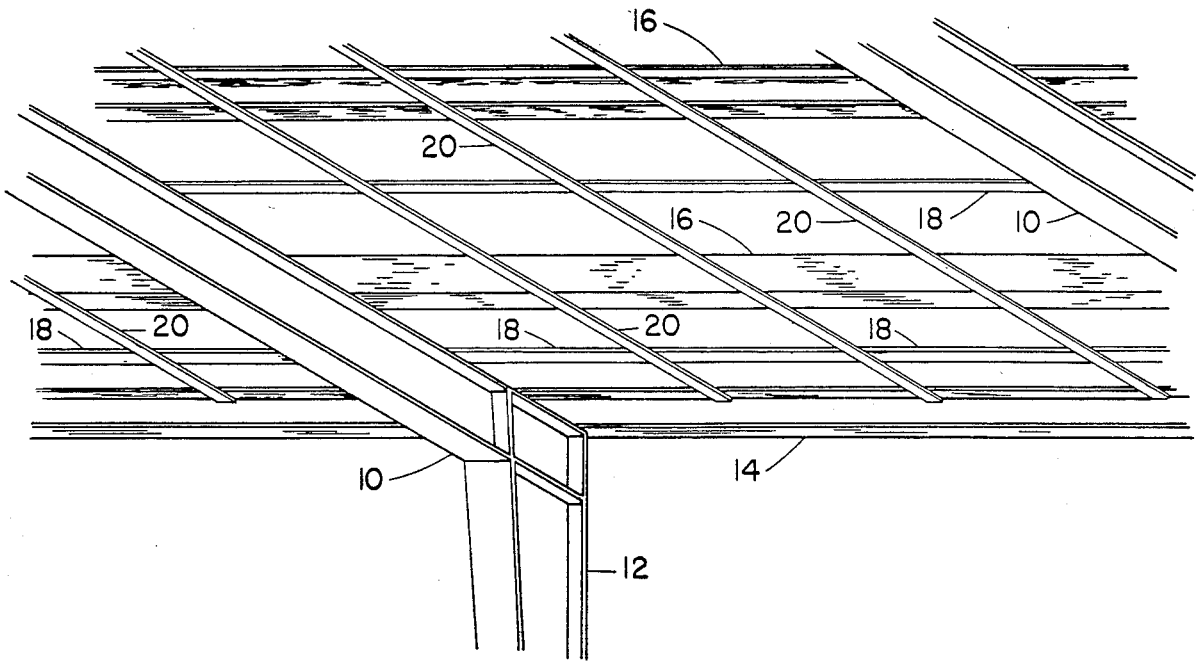
FIG. 2 is a perspective view showing a support band grid-work.
Figure 3:
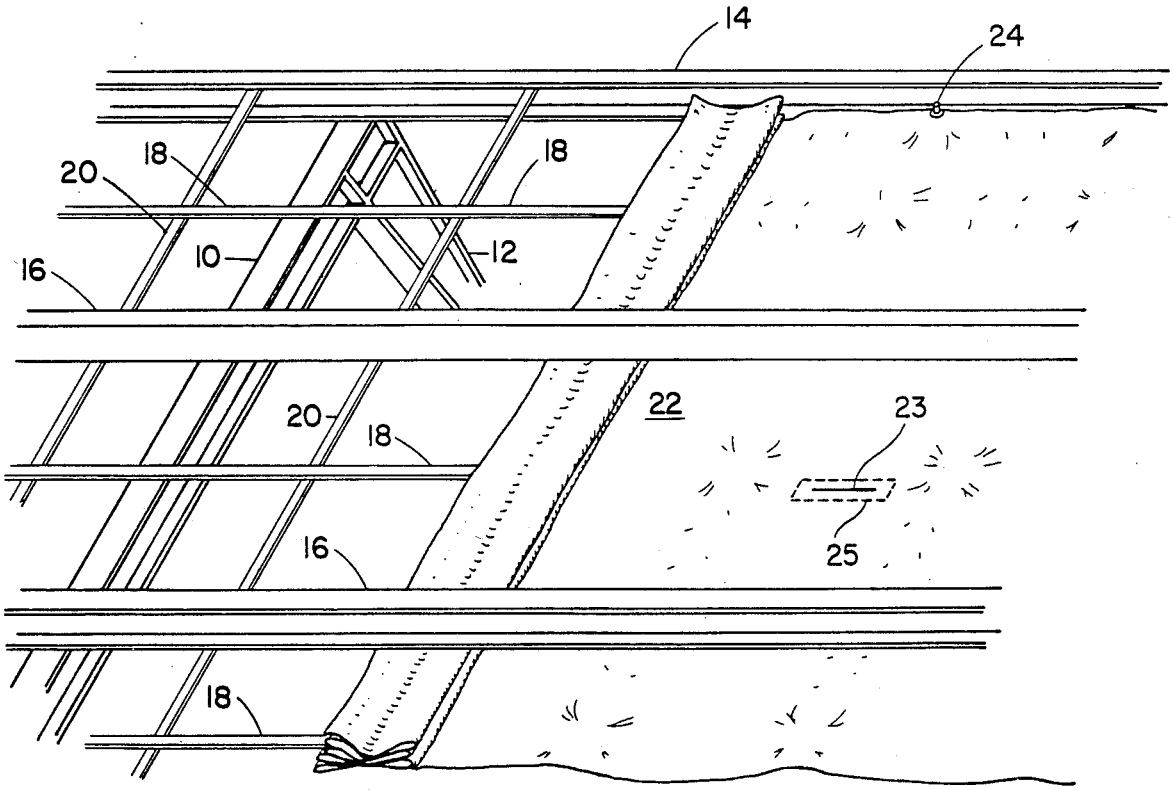
FIG. 3 is a perspective view showing a support band grid-work with a partially placed support sheet.
Figure 6:
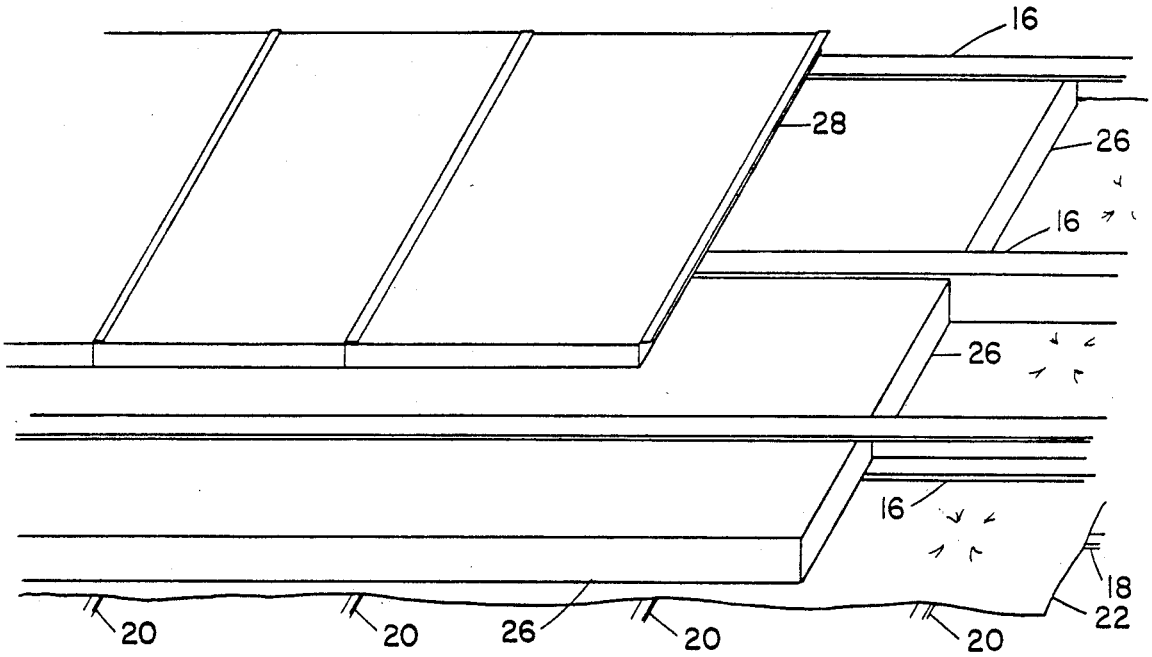
FIG. 6 is a cut-away perspective view showing double insulation placement.

As shown in FIG. 2, the apparatus of the present invention includes a grid-work formed from steel, longitudinal bands 18 and steel transverse bands 20. The bands 18,20 are supported by various structural members and define a plane parallel to the lower surface of the purlins 16. The bands 18,20 support a high strength sheet support material 22, as shown in FIG. 3. The support material 22 in the preferred embodiment also serves as a vapor barrier. Pan insulation blocks 26 are positioned between the purlins 16 and supported by the vapor barrier sheet 22, as shown in FIGS. 4–7. Rolled insulation material 28 is rolled transversely across the tops of the purlins 16, as shown in FIGS. 5 and 6. An air gap 27, created between the rolled insulation 28, provides a dead air space which increases the insulating effectiveness of the structure. Roofing material 30 is attached above the upper insulating material 28. In the preferred embodiment the roofing material 30 is shown to be a corrugated sheet metal, however, numerous types of roof sheeting may be employed and are compatible with the invention.

The installation of the suspension system will now be described. Longitudinal metal bands 18 are suspended from end wall 11 to end wall 11 perpendicular to the main rafters 10. The number of longitudinal bands 18 to be used is dependent on spacing of the purlins 16. The simplest case is depicted in the preferred embodiments where only a single band 18 is positioned between each pair of purlins 16. However where the purlin spacing is wider, numerous bands 18 may be required and are spaced at distances of equal proportions between each set of purlins 16. The longitudinal bands 18 are placed over the top of each rafter 10 and generally need to be rigidly attached only at the upper surface of the end wall rafters 11. However, where the building is extremely long, it may be necessary to attach the bands 18 to the upper surface of one or more intermediate rafters 10. The bands 18 are fastened to the upper surface of the end rafters 11 (and if necessary, to intermediate rafters 10) by conventional attachment means. However, in the preferred embodiment, self-drilling or self-tapping metal sheeting fasteners (not shown) are used to increase the speed of the installation. The longitudinal bands 18 must not be allowed to sag between rafters 10 and, therefore, it may be necessary to use a band attachment tool and splice clips (not shown) to produce tension in the bands 18.

Transverse bands 20 are installed after the longitudinal bands 18 are in place. These bands 20 are first attached to the bottom edge of each eave strut 14 on one side of the building. The bands are then pulled tight to minimize sag and are attached to the bottom of the eave strut 14 on the opposite side of the building. The number of transverse bands 20 to be used will, of course, vary with the distance between rafters 10. In new structures, three equally spaced bands per bay 13 are most efficient but the maximum distance between traverse bands 20 should not exceed seven feet. At the completion of the installation process, the transverse bands 20 are attached to the purlins 16 and provide vertical support to the longitudinal bands 18. No transverse bands 20 are required in the immediate area of the rafters 10 since the longitudinal bands 18 lay over the rafters 10 and are supported by the rafters 10 at that point. In buildings with a flat roof, the length of each transverse band 20 is approximately the width of the building between eave struts 14. However, where the building has a gabled roof, the transverse bands 20 must be long enough to accommodate the extra width of the roof occasioned by the upward inclination of the roof. Since the transverse bands 20 are installed below the longitudinal bands 18 and are unsupported except at the eave struts 14, a noticeable sag will be present in the bands 20 initially. In cases where the building is over 80 feet wide, or where the gable of the building is extremely high, it is recommended that the transverse bands 20 be installed in two sections running from each eave strut 14 to the ridge 17.

The suspension material 22, which in the preferred embodiment consists of a vapor barrier material, is trimmed to size before installation. The suspension material 22 is installed one bay 13 at a time and, in the case of large buildings or buildings with high gables, the material 22 for each half of the bay divided by the ridge 17 is installed separately.

After the suspension material 22 has been cut to a size having a dimension a few inches longer than the dimensions of the bay 13 to be covered, it must be folded for easy spreading above the bands 18 and 20. For this purpose a zig zag type fold, as shown in FIG. 3, has proven to be the easiest to work with, although other rolling or folding arrangements could also be used and are within the scope of the invention. After the suspension material 22 has been folded to a convenient size, it is lifted up and laid across the top of the longitudinal band 18 system. The suspension material 22 is then unfolded on top of the bands 18 and pulled into position. Care should be taken to remove wrinkles prior to permanent attachment of the material 22. After the suspension material 22 has been properly positioned, it is glued or stapled at the eave struts 11 and rafters 10. A band fastener 24 is then used to attach each transverse band 20 and associated purlin 16 at the point where the transverse bands 20 and purlins 16 intersect. The fastener 24 also passes through the suspension material 22 and has the effect of holding it in a fixed position with respect to the band grid-work. At this point the installation of the suspension system for a particular bay 13 is complete. Installation of insulating material 26,28 and roof sheeting 30, as more fully described below, takes place immediately after the placement of the suspension material 22 in each bay 13, with each bay 13 being completed before proceeding to the next bay 13.

Figure 7:
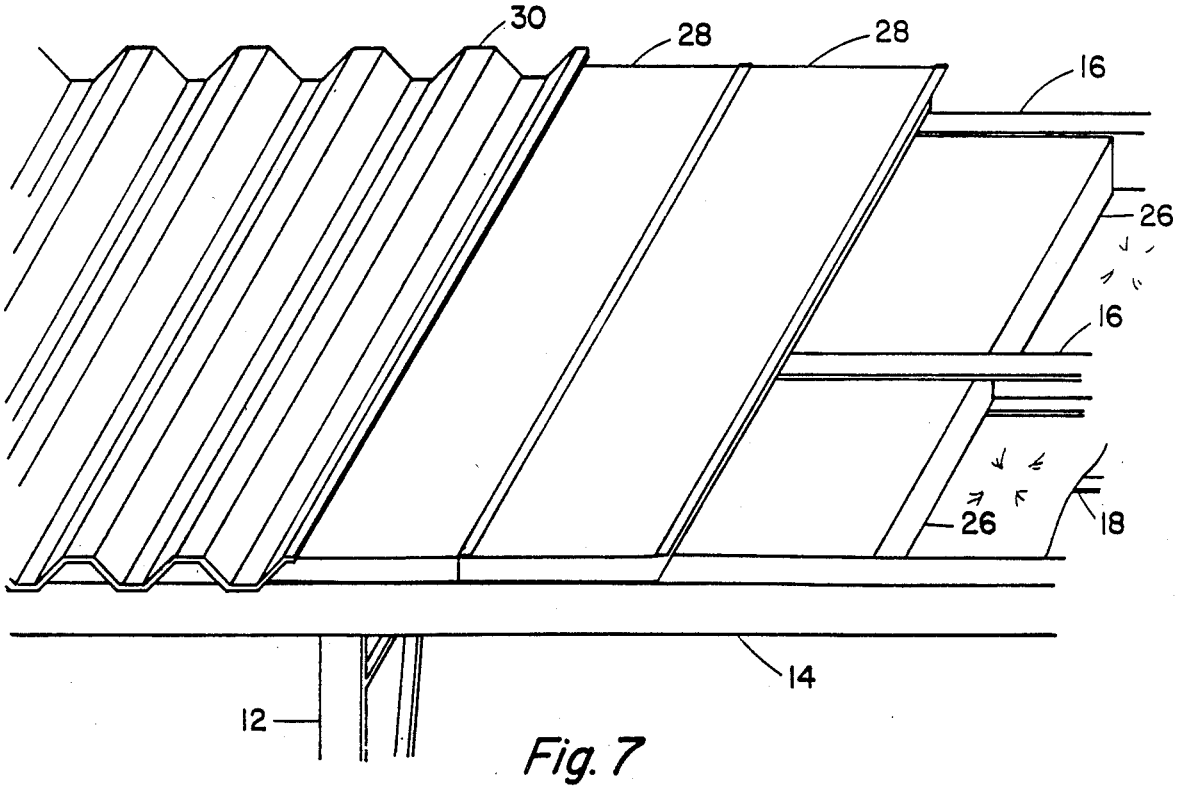
FIG. 7 is a cut-away perspective view showing single insulation placement and roof sheeting placement.
Figure 8:
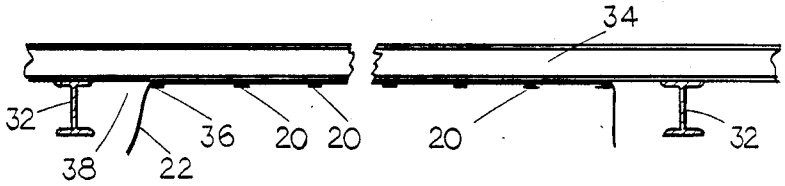
FIG. 8 is a partial side view illustrating an alternate retrofit method of insulating.
Figure 9:
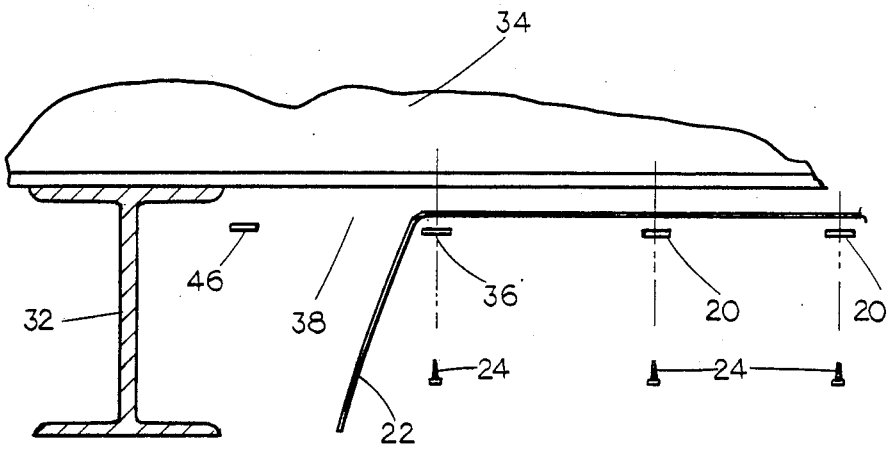
FIG. 9 is an enlarged illustration of a portion of FIG. 8.

A number of options exist for installation of insulating materials. In the preferred embodiment, pan insulation 26 is installed between each pair of purlins 16. Since the roof is open, the pan insulation 26 may be laid into the area between purlins 16 from above. Pan insulation 26, having a sufficient width and depth to fill the entire area between the purlins 16 and the suspension material 22, should be used for maximum insulating effect. It is then possible to install roof sheeting material 30 directly on top of the purlins 16, as shown in FIG. 7. This allows direction attachment of the roofing material 30 to the purlins 16 and provides greatly improved heating efficiency over conventional systems. However, additional insulating benefits are achieved by installing a second layer of insulation 28 over the tops of the purlins 16 and pan insulation 26. A dead air gap 27 is thus formed between insulating layers which further enhances the insulating effect, thereby increasing the heat retention of the building. The second insulating layer 28 is generally applied in transverse strips, using roll insulation, as shown in the cut-away drawing in FIG. 6. In this case, the roofing material 30 must be attached to the purlins 16 through the second layer of insulation material 28. This may be accomplished either by compressing the insulating material 28 in the area of the purlins 16 or by providing "stand off" roof fasteners (not shown) to hold the sheeting material 30 a fixed distance from the purlins 16. In a situation where a second insulating layer 28 is not used, a simple thermal brake material (not shown) is applied at the top and/or bottom of each purlin 16 and eave strut 14 prior to attachment of roofing material 30. This prevents direct conduction of heat through the metal surface of the purlins 16 and roof 30.

Essentially the same method may be used for installing insulation in a previously constructed building. The band grid-work 18,20 and suspension material 22 are installed in exactly the same way. However, due to the fact that the roof 30 has already been placed, pan material 26 and an upper insulation layer 28 may not be used in this particular method. In its place, particulate or foam fiberglass or mineral wool insulation is blown into the void between the roof 30 and the suspension material 22. In order to blow the material in, a small slit 23 is made in the suspension material 22 between each set of purlins 16 in each bay 13, or every other bay 13, depending upon how far the insulation may be blown. After each space is filled, a sealing tape 25 is applied over the access slit 23 to prevent the loss of the insulating material. Although this method is used primarily in buildings which have already been completed, it may also be used in new buildings, especially when weather conditions make it desirable to quickly cover the roof to afford enclosed working space.

In some situations, especially those encountered when installing insulation in a previously constructed building, the longitudinal bands 18 may entirely be eliminated and transverse bands 20 are used exclusively. The transverse bands 20 are installed exactly as described above and an increased number of bands 20 are used to provide needed support. It is recommended when only transverse bands 20 are being used that the bands 20 be spaced a maximum distance of 24 inches apart. The remaining installation steps may then be completed as described above, depending on the particular characteristics of the building.

A method of installing blanket type insulation, even in retrofit applications, is described in connection with FIGS. 9–12. The building structure is diagrammatically illustrated as including spaced-apart primary structural members 32 which may be rafters, as illustrated, building walls or any other such primary support. The secondary structural members 34 are arranged in spaced relation perpendicular to the primary structural members and may be purlins, bar-joists, wood rafters or any of various other secondary structural members. Transverse bands 20 are installed as described above so as to extend across the undersides of the secondary structural members 34. The bands are supported at their opposite ends by securement to an eaves strut, ridge member, angle iron or such other structure as is provided in a particular building. A suspension sheet 22 is cut to a length slightly greater than the distance between the primary structural members 32 and of a width sufficient to cover the entire roof portion being insulated. The suspension sheet is spread out on the bands 20 with each end of the sheet hanging downwardly over a band 36 which is spaced preferably about 24 inches to 36 inches from the adjacent primary structural member 32 to thereby define an opening 38.

Figure 10:
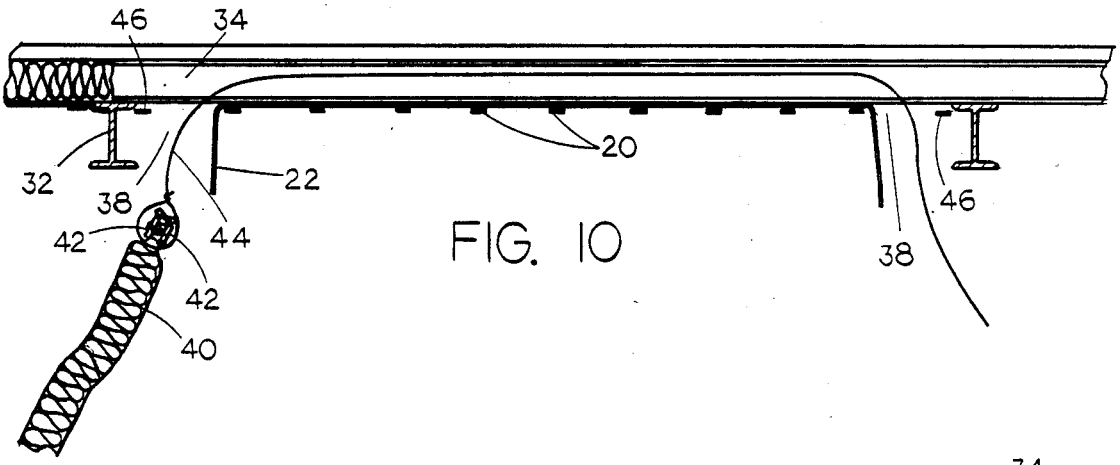
FIG. 10 is a side view showing one end of blanket insulation being inserted into the insulation system.
Figure 11:
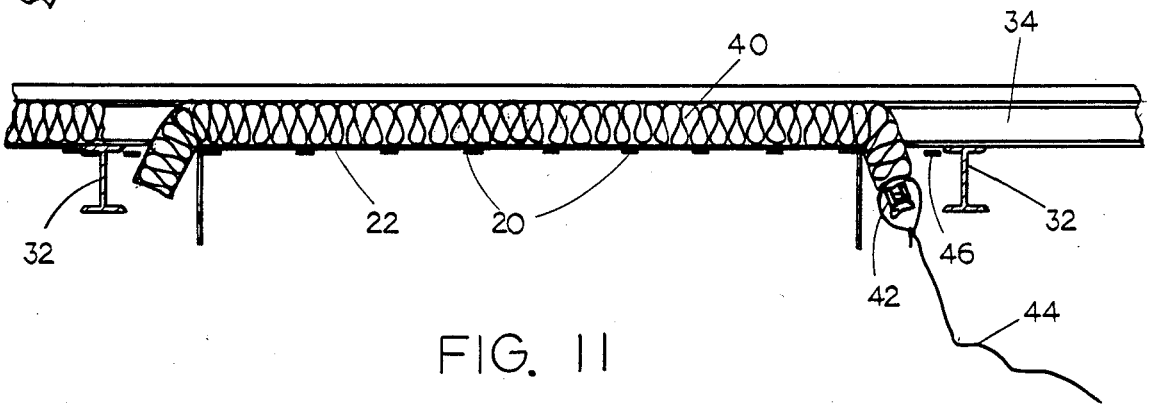
FIG. 11 is similar to FIG. 10 showing the blanket insulation pulled into place.
Figure 12:
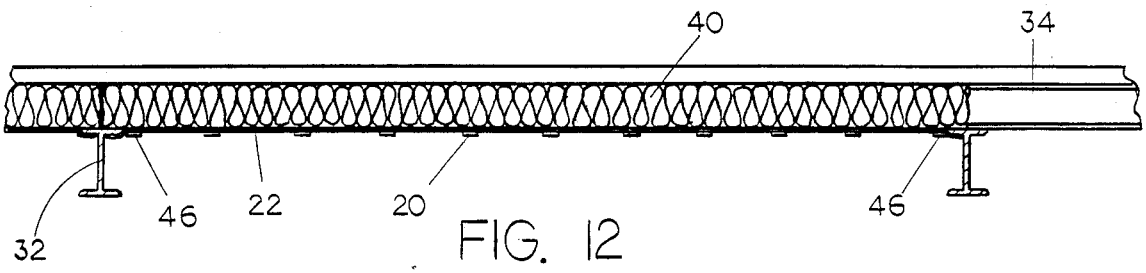
FIG. 12 is similar to FIG. 11 showing the suspension material secured at its ends to complete the system.

Referring to FIG. 10, strips 40 of blanket insulation are provided, each having a width approximately equal to the spacing between secondary structural members 34 and a length approximately equal to the spacing between primary structural members 32. To insert one end of the blanket insulation 40 into the opening 38, the end is prepared by clamping it between a pair of elongated clamp bars 42 which may be secured together by through bolts, for example. A rope 44 is then fished across the top of the of the suspension sheet with a steel fish tape, for example, whereupon the end of the rope is tied around the clamp bars so that when the opposite end of the rope is pulled, the insulation strip 40 is drawn up over and across the suspension sheet 22 to span the distance between primary structural members 32 as shown in FIG. 11. The rope 44 and clamp bars 42 are removed and the ends of the insulation is pushed into place, whereupon the hanging ends of the suspension sheet 22 are then secured to the primary structural members 32 to close the openings 38. For this purpose, an additional band 46 is provided directly adjacent the primary structural member 32 so that the suspension sheet may be drawn over the band 46 with the terminal end portion of the sheet secured to the primary structural member by adhesive or the like. Conventional band fasteners 24 would be inserted through the bands 46 at each point of intersection with the secondary structural members 34. Thus a method is provided for installing blanket insulation even in applications where access from the top is not available.

Figure 13:
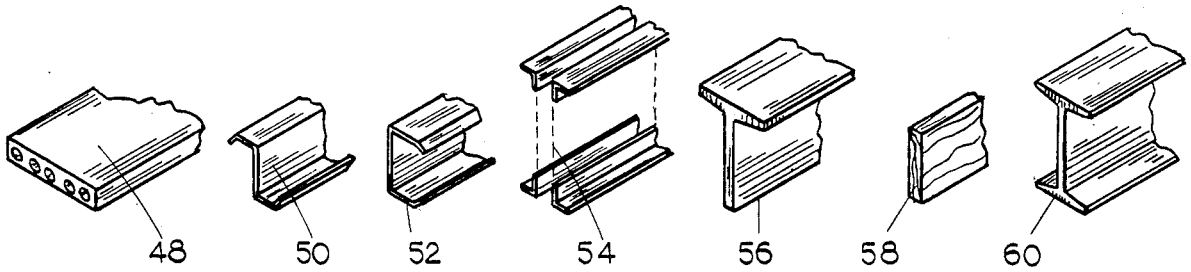
FIG. 13 is an end sectional view of a plurality of secondary structural building elements.

As mentioned above, the system is adaptable to any roof construction employing structural cross members to support the roof. For instance, in a masonary building with all bar-joist construction, the bar-joist may span the entire width of the building and bear directly on the masonary walls. In this situation, the bar-joists are equivalent to the purlins and the suspension system is installed on the bottom plane of the bar-joists. With masonry walls, there are not eave struts or end beam rafters and installation of a support such as angle iron near the upper edge of the walls is required. The angle iron then serves the same purpose as the eave struts and end beam rafters in attaching the band grid-work. FIG. 13 illustrates a non-exclusive grouping of various types of secondary structural members, specifically including flat concrete 48, Zee purlins 50, C-channel 52, bar-joists 54, concrete tees 56, wood rafters 58 and hot rolled beams 60.

Figure 14:
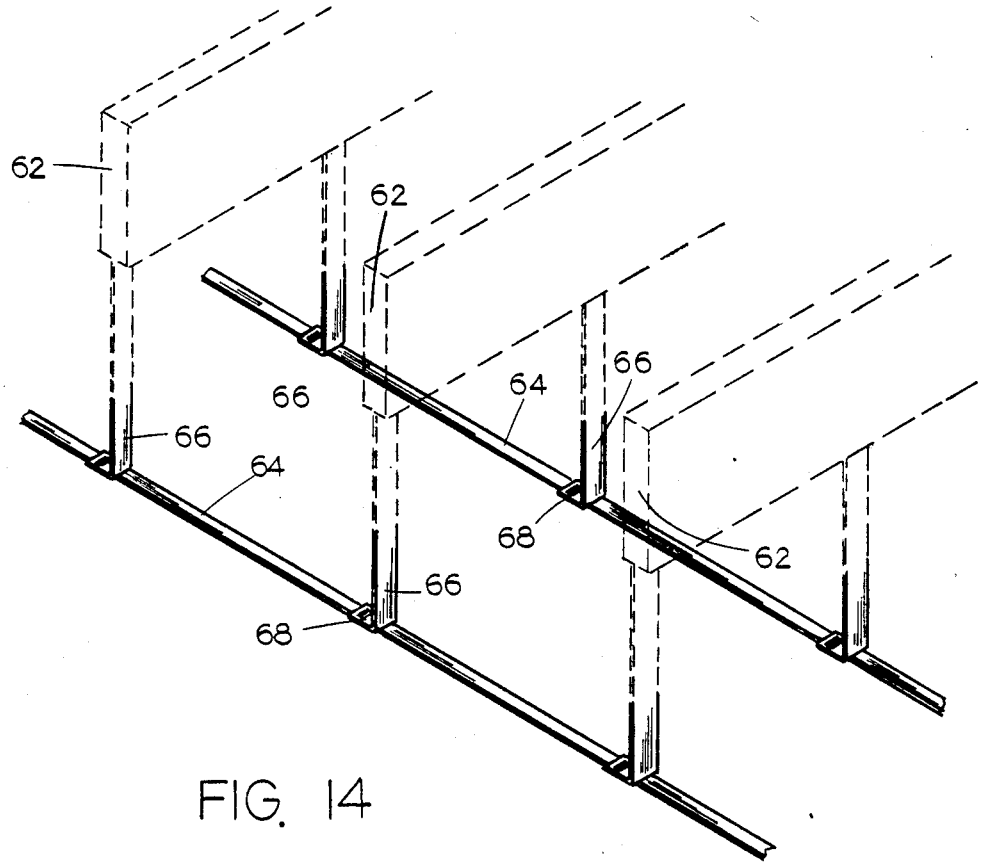
FIG. 14 is a perspective illustration of a plurality of elongated bands supported by band hangers from a plurality of structural members.

In FIG. 14, the dotted line secondary structural members 62 are intended to be indicative of any type of secondary structural member. Number 64 indicates the transverse bands and this figure illustrates an alternate system for connecting the bands to the secondary structural members 62, specifically using a plurality of band hangers 66. The upper ends of band hangers 66 and shown in dotted lines since these will vary depending upon the type of secondary structural member 62 they are used with, as illustrated in the following figures. The lower ends of the bands are preferably provided with a horizontal apertured portion 68 through which a coacting fastener may be inserted to secure the band 64 and suspension sheet 22 to the underside of the hanger.

Figure 15:
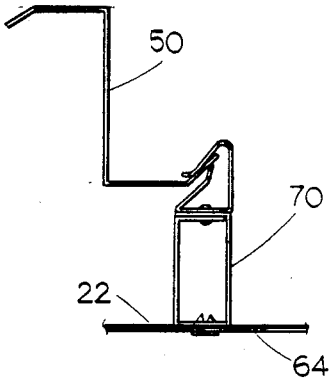
FIG. 15 is a partially sectional side view of a band hanger on a Zee purlin.
Figure 16:
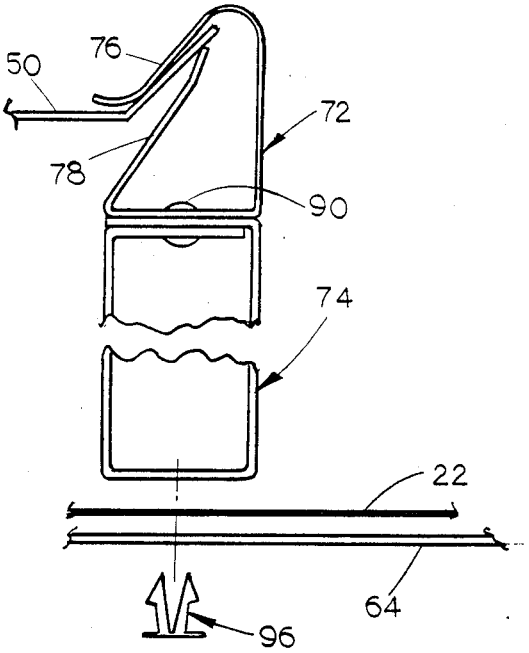
FIG. 16 is an enlarged side view of the band hanger of FIG. 15.
Figure 17:
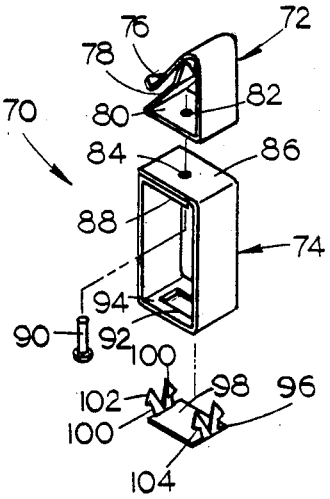
FIG. 17 is an exploded perspective view of the band hanger of FIG. 15.
Figure 25:
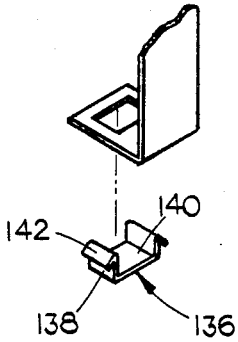
FIG. 25 is a perspective view of an alternate clip.

FIGS. 15 and 16 show a band hanger 70 mounted on the upturned lip 71 of the lower flange of Zee purlin 50. The same hanger is used for connecting bands to a C-channel. As seen in FIG. 17, hanger 70 includes an upper generally triangular fastener portion 72 and a lower rectangular hanger portion 74. Triangular fastener portion 72 has overlapping end portions 76 and 78 which yieldably receive and pinch the lip 71 of the purlin therebetween. A lower horizontal portion 80 has a hole 82 for registration with holes 84 in the overlapped ends 86 of hanger portion 74. A rivet 90 permanently connects the portions together. An elongated slot 92 is provided in the bottom horizontal portion 94 for receiving a generally U-shaped coacting fastener clip 96. Clip 96 includes a flat band support web 98 having a pair of snap-fit legs 100 at each end thereof, which legs have downwardly and outwardly inclined upper edges 102 and exterior shoulders 104 for engaging the edges of slot 92 when pressed therein, as illustrated in FIG. 25.

Figure 18:
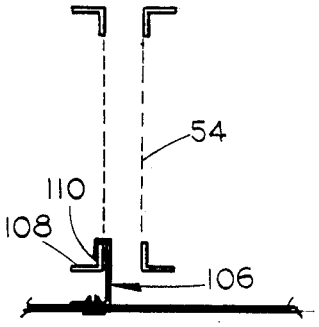
FIG. 18 is a partially sectional side view of a band hanger on a bar-joist.
Figure 19:
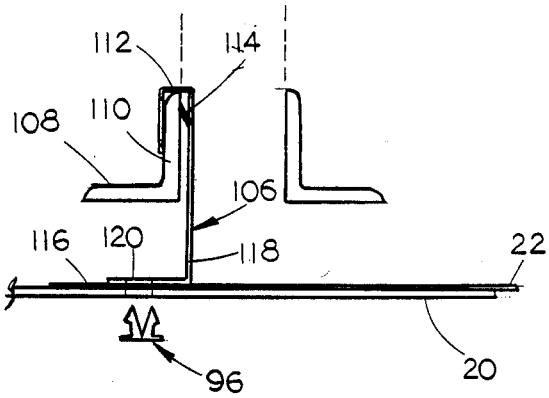
FIG. 19 is an enlarged side view of the band hanger of FIG. 18.

Another hanger 106 is illustrated in FIGS. 18 and 19 for use with a bar-joist 54 having a pair of oppositely disposed angle members 108 at the lower end thereof, each with an upright flange 110. Hanger 106 includes a hooked upper portion 112 for engaging the top of flange 110 and an upwardly directed tongue 114 bent outwardly in the same direction as the hook to pinch the flange between the hook 112 and tongue 114. The lower portion 116 of hanger 106 is bent at a right angle to upright stem portion 118 and includes an elongated slot 120 for receiving a clip fastener 96.

Figure 20:
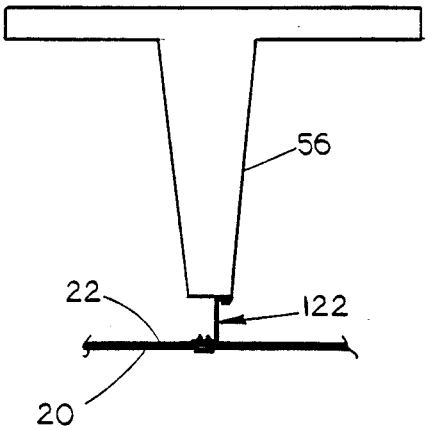
FIG. 20 is a partially sectional side view of a band hanger on a concrete tee.
Figure 17A:
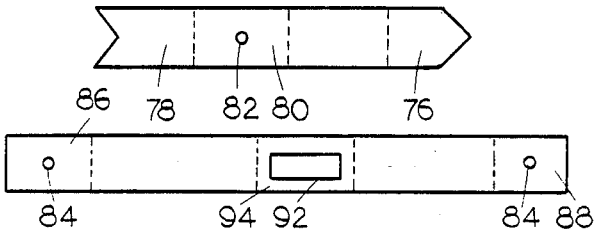
FIG. 17A is a top plan view of the blanks for the hanger of FIG. 15.
Figure 21:
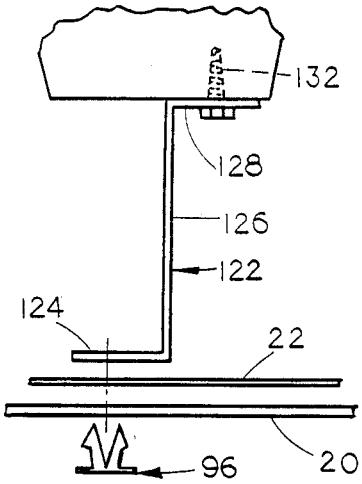
FIG. 21 is an enlarged side view of the band hanger of FIG. 20.

FIGS. 20 and 21 show another hanger 122 adapted for use with a concrete tee 56. Hanger 122 has a lower portion 124 identical to lower portion 116 of the previous hanger, an upright stem portion 126 and an upper portion 128 bent at a right angle to the stem and having a hole 130 for receiving a concrete fastener 132 as shown in FIG. 21.

Figure 22:
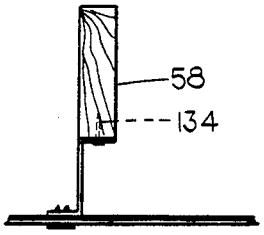
FIG. 22 is a partially sectional side view of a band hanger on a wood rafter.
Figure 23:
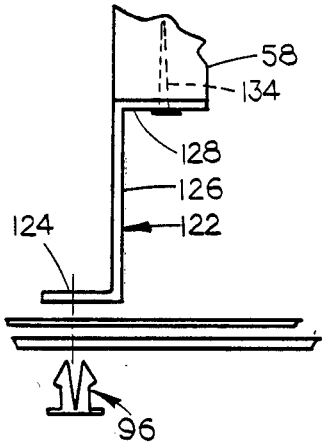
FIG. 23 is an enlarged side view of the band hanger of FIG. 22.
Figure 24:
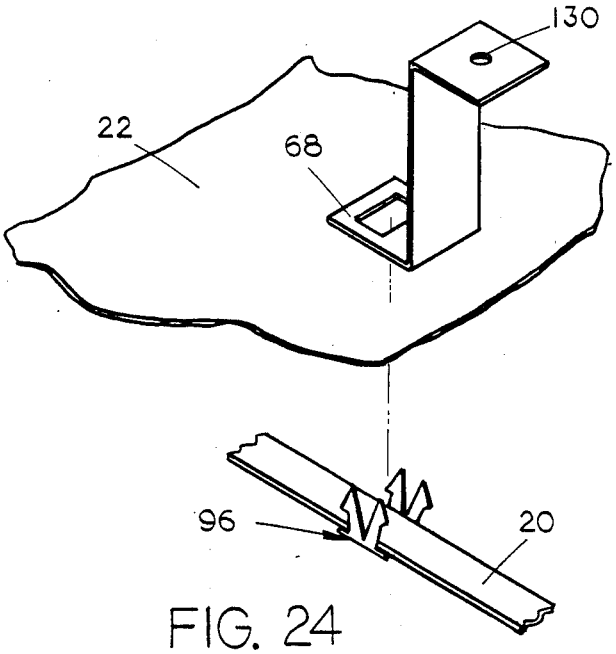
FIG. 24 is a perspective view of the coacting fastening clip for the band hanger.

The same hanger may be used for flat concrete as illustrated at 48 in FIG. 13 although the stem portion 126 may be longer to create the desired cavity depth. Hanger 122 is also readily adaptable for use with a wood rafter 58 or truss as illustrated in FIGS. 22 and 23, wherein a ring shank nail 134 is inserted through hole 134 attaching the hanger to the rafter 58.

The method of using the band hangers, referred to generally by numeral 66, is as follows. All of the hangers are first attached to the secondary structural members at the desired points of intersection with the transverse bands 20. The transverse bands are then suspended in place by securement of the opposite ends of the bands to the building structure. The suspension sheet is then unfolded and spread out on the bands to the extent of the walls or other termination points of the particular roof section being insulated. Note that the suspension sheet 22 is thus situated above the bands 20 and below the horizontal portion 68 of the hanger. A fastener clip 96 is then placed for receiving the band on the web portion thereof, whereupon the clip is pushed upwardly so that the legs 100 pierce the suspension sheet and snap into the slot in the horizontal portion 68 of the hanger.

FIG. 25 illustrates an alternate form of clip fastener 136 wherein a single leg 138 extends upwardly from each end of web 140 and is provided with a downwardly and upwardly inclined flange 142 for snap-fit against the opposite ends of the hanger slot.

Figure 26:
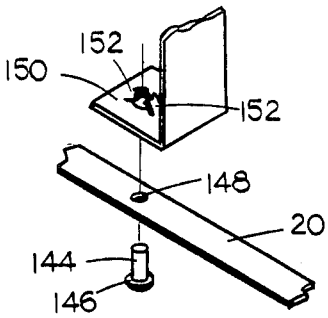
FIG. 26 is a perspective view of an alternate hanger/-stud combination.
Figure 27:
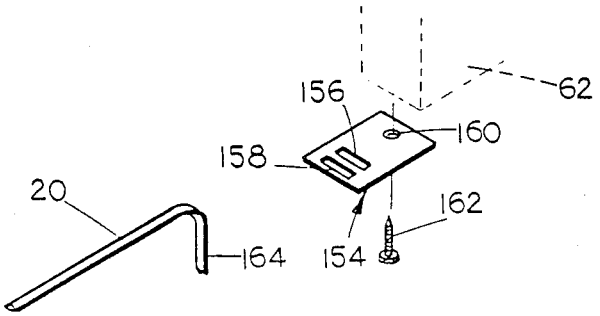
FIG. 27 is a perspective view of a fastening clip for the end of a band.

FIG. 26 shows yet another embodiment of a fastener clip 144 which is provided as a round shaft steel stud or nail having a head 146 on the lower end thereof. This type of fastener, however, requires that a hole 148 be made in the transverse band 120 at the point of attachment to the band hanger horizontal portion 150 which is formed with raised spring steel friction lock legs 152 for nonreleasably gripping the clip 144 when the shaft is inserted between the legs 152. An advantage of using the U-shaped clip fastener 96 rather than the shaft type clip 144 is that the bands need not be pierced, with the result that a thinner, less expensive band material may be effectively used in the system.

FIGS. 27–30 illustrate a flat clip 154 for facilitating the connection of one end of a transverse band 20 to a horizontal surface such as the underside of a secondary structural member 62. One application is shown in FIGS. 2 and 3 wherein the end of bands 20 are secured to the underside of the upper flange of eave strut 14. In other embodiments, an angle iron may be secured to a wall with the outwardly extended flange of the angle iron member serving as the horizontal surface for attachment of the ends of the transverse bands 20. Flat clip 154 is adapted for use in all such applications.

Figure 28:
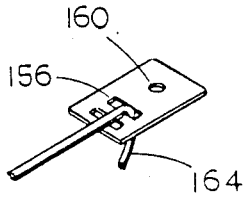
FIG. 28 is a perspective view showing the band partially inserted into the clip.
Figure 29:
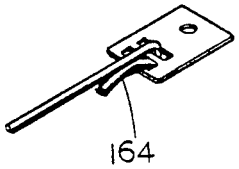
FIG. 29 is a perspective view showing the band fully secured by the clip.
Figure 30:
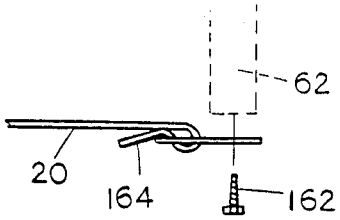
FIG. 30 is a side view of the band and clip of FIG. 29.
Figure 31:
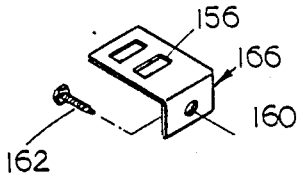
FIG. 31 is a perspective view of an alternate band clip.

Clip 154 is shown as an elongated flat plate having a pair of adjacent transverse slots 156 and 158 adjacent one end and a hole 160 adjacent the other end for receiving a fastener such as the self-tapping screw 162 for securing the clip to the secondary structural member 62. End 164 of band 20 is turned downwardly and inserted through inner slot 156 as shown in FIG. 28. The same end 164 is then inserted up through outer slot 158 and pulled rearwardly back along the length of the band as shown in FIGS. 29 and 30. The band end 164 is thus pinched between the clip 154 and band 20 for a secure nonslip hold. A similar clip 166 is shown in FIG. 31 for securement of the bands to a vertical surface. Clip 166 is similar to clip 164 except that it may be slightly longer and have a right angle bend between inner slot 156 and mounting hole 160.

Figure 32:
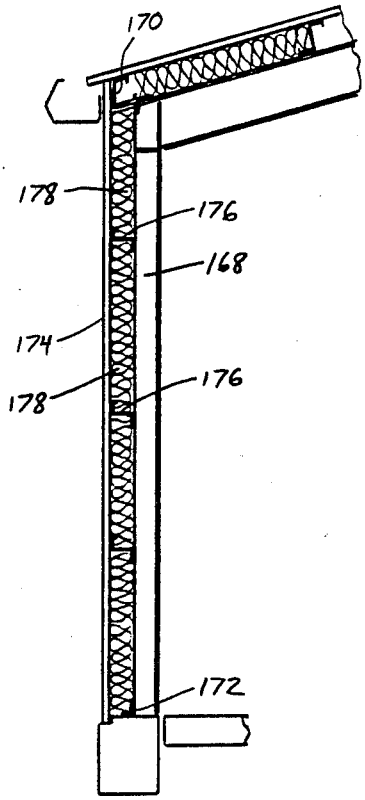
FIG. 32 is a side sectional view of the insulation system in a wall structure.
Figure 33:
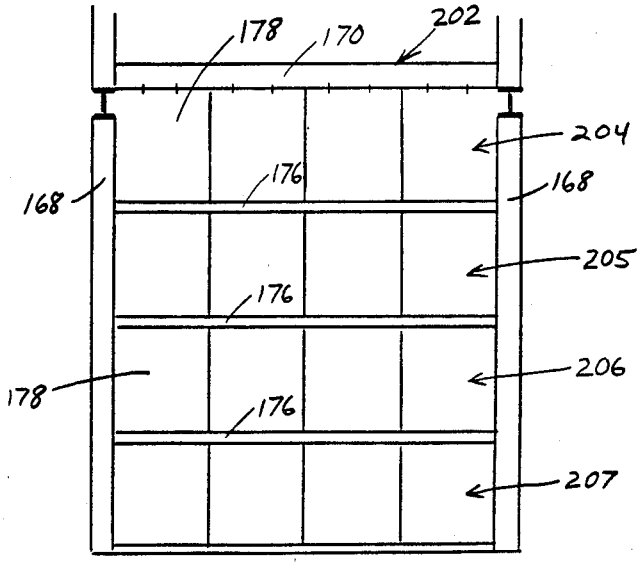
FIG. 33 is a front elevational view of a portion of a wall showing strips of insulation suspended therein.

Whereas the building insulation system of the present invention has heretofore been described in connection with the insulation of various types of roof structures, it is also well-suited for the insulation of building walls as illustrated in FIGS. 32–36. In FIGS. 32 and 33, it is seen that either a wall portion or an entire wall may be defined by a pair of upright primary structural members 168 such as the columns 12 of the metal building shown in FIG. 1. The vertical limits of each wall section are defined by upper and lower cross members 170 and 172 which extend between the primary structural members 168. In the embodiment illustrated, the upper cross member 170 is the eave strut and the lower cross member 172 is an angle iron member secured to the building floor. Some type of wall panel 174 extends between and is secured to the primary structural members 168 to cover and close the space between them.

The wall shown in FIGS. 32 and 33 is additionally provided with intermediate horizontal secondary structural members 176 which define individual wall portions therebetween, bordered on the opposite ends by the primary structural members 168.

Figure 34:
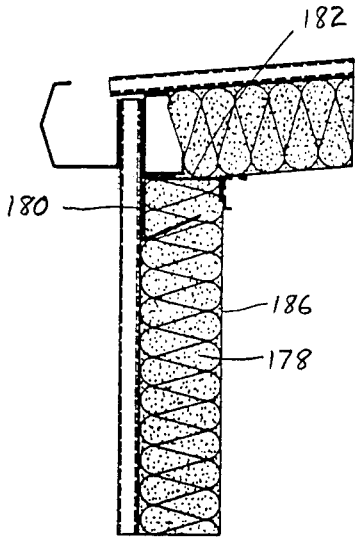
FIG. 34 is a detail side sectional view showing a wire hanger for the wall insulation.
Figure 35:
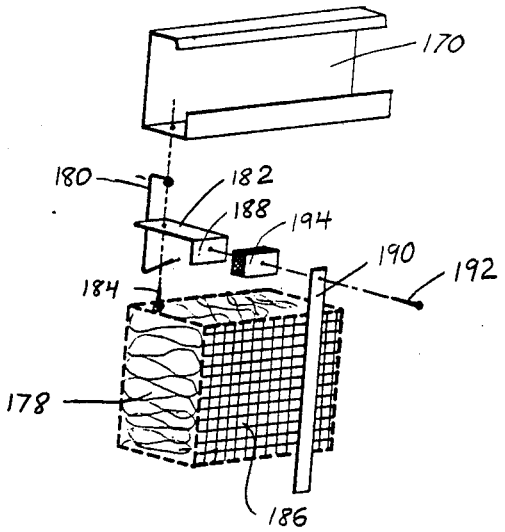
FIG. 35 is a perspective view of the wire insulation hanger of FIG. 34.

The first step is to fill the individual wall section with insulation material. Referring to the top wall section defined by eave strut 170 on the uppermost intermediate member 176, four strips 178 of insulation material are placed in side-by-side relation within the wall section to completely fill it from side-to-side and from top-to-bottom. Certain forms of insulation having a height of five feet or less will be self-standing and remain in place without securement brackets. Some type of hanger is generally desirable, however, to prevent settling. One form of hanger is illustrated in FIGS. 34 and 35. A somewhat C-shaped wire 180 is placed against the underside of eave strut 170 and secured in position by an outwardly extended bracket 182 and screw fastener 184. The inclined bottom portion of the wire 180 piercing the insulation and supports it adjacent the top of the wall section. Alternatively, a wire may be simply extended through the insulation material and directed upwardly through a hole in the eave strut for tying the insulation strips in place.

Figure 36:
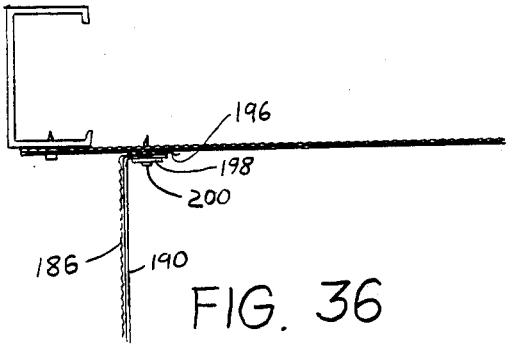
FIG. 36 shows an alternate support for the wall bands.

The second step is to install a continuous independent suspension sheet 186 having a width sufficient to stand between a pair of the primary structural members 168 and a height at least slightly greater than the floor-to-ceiling height of the wall. The suspension sheet 186 is placed against the interior surface of the insulation strips 178. FIGS. 35 and 36 show two different ways of supporting the suspension sheet 186 in place. In FIG. 35, the suspension fabric is pinched between the downturned end 188 of bracket 182 and a vertical band 190 which is secured to the bracket by a screw fastener 192. Optionally, a thermal insulation block 194 may be interposed between the bracket and band to block any thermal conduction between the band and building structure.

In the method shown in FIG. 36, an upper edge 196 of the suspension sheet 186 is folded over an extra horizontal band 198 of the roof insulation system and secured in place by the conventional fasteners 200 for securing the band 198 to the secondary structural members of the roof.

Next, additional horizontal and vertical bands may be extended across the interior face of the suspension sheet for providing added support. Whereas no horizontal bands may be used in certain applications, it is generally desirable to provide vertical bands having a maximum spacing of approximately five to six feet.

The final step of the wall insulation method is to connect or seal the edges of the suspension sheet to the primary structural members 168 and lower cross member 172, such as by adhesives.

For clarity, the wall, referred to generally by numeral 202 in FIG. 33 is construed as including four separate wall sections 204, 205, 206 and 207 each of which transversely spans the distance between primary structural members 168. Wall 202 may itself be one segment of a longer wall in a building such as that illustrated in FIG. 1 where a number of columns are provided along a single wall.

Whereas the invention has been shown and described herein in association with preferred embodiments thereof, it is to be understood that many modifications, additions and substitutions may be made which are within the intended broad scope of the appended claims.

I claim:

1. In a building including opposite end walls interconnecting opposite side walls and a ceiling covering the space between said end walls and side walls, a system for insulating said ceiling, including a plurality of longitudinal support bands, means for suspending said longitudinal support bands from said ceiling in spaced-apart relation between said end walls and in vertically spaced relation from said ceiling, an independent suspension sheet, said sheet overlying said bands and being supported thereon, said suspension sheet extending substantially from end wall to end wall and substantially from side wall to side wall to thereby separate said ceiling from the space below said suspension sheet, band fastener means for connecting said bands to said ceiling at spaced apart positions along said bands, said suspension sheet means being continuous but for the passage of said band fastener means therethrough, and thermal insulation material disposed between said suspension sheet and ceiling and supported on said suspension sheet.

2. The system of claim 1 wherein said suspension sheet is made of a vapor barrier material.

3. The system of claim 2 wherein said vapor barrier suspension sheet is seamless.

4. The system of claim 1 further comprising spaced transverse support bands suspended between said side walls in vertically spaced relation from said ceiling whereby said longitudinal support bands and transverse support bands form a suspension grid-work.

5. In a building roof structure including secondary structural members extending longitudinally between a pair of oppositely situated primary structural members and a ceiling covering the space between said structural members, a system for insulating, said ceiling, including a plurality of generally parallel elongated support bands extended transversely across the undersides of a plurality of said secondary structural members in longitudinally spaced-apart relation, a plurality of band hangers associated with each support band, said band hangers having upper and lower ends and means for connecting the upper ends to the secondary structural members and means for connecting the lower ends to the associated support band, an independent suspension sheet interposed between said bands and band hangers so as to be supported on said bands, said suspension sheet extending longitudinally between said pair of primary structural members and transversely across a plurality of said secondary structural members, and coacting fastener means for connecting said bands to the lower ends of said band hangers, said fastener means piercing said suspension material at the point of connection to said band hangers.

6. The insulating system of claim 5 wherein said secondary structural members are selected from the group consisting of purlins, C-channels, bar-joists, concrete tees, wood rafters, hot rolled beams and flat concrete.

7. The insulating system of claim 5 wherein said lower end of each band hanger includes a generally horizontal portion having an opening therein.

8. The insulating system of claim 7 wherein said coacting fastener means comprises a generally U-shaped clip including opposite legs adapted for snap-fit connection to said horizontal portion upon insertion into the opening therein.

9. The insulating system of claim 8 wherein said band is received on said U-shaped clip between the legs thereof.

10. A method of installing insulation in the roof of a building including a pair of generally parallel spaced-apart primary structural members and a roof structure including a plurality of secondary structural members extending between said primary structural members in generally parallel spaced-apart relation and a ceiling covering the space between said structural members, comprising the steps of extending a series of metal bands across the undersides of a plurality of said secondary structural members, supporting the opposite ends of said bands, providing a continuous independent suspension sheet having a width sufficient to span a plurality of said secondary structural members and a length at least slightly greater than the distance between said pair of primary structural members, positioning said suspension sheet on said bands, spreading out said suspension sheet on said bands to span a plurality of said secondary structural members, each end of said sheet hanging downwardly over a band situated in spaced relation from a respective primary structural member thereby to define an opening between said suspension sheet and primary structural member, providing an elongated strip of blanket insulation having a width generally equal to the spacing between secondary structural members and a length generally equal to the spacing between said pair of primary structural members inserting one end of said blanket insulation into the opening adjacent one primary structural member, pulling said blanket insulation over and across said suspension sheet to generally span the distance between primary structural members, and securing the hanging ends of said suspension sheet to the adjacent primary structural member to thereby close said openings.

11. The method of claim 10 further comprising clamping a pair of elongated clamp bars onto one end of said strip of blanket insulation, fastening one end of a rope to said one end of the strip of blanket insulation, fishing said rope up through the opening adjacent one primary structural member, across said suspension sheet and down through the opening adjacent the other primary structural member, said pulling step including pulling said rope to draw said blanket insulation over and across said suspension sheet.

12. The method of claim 10 wherein said securing step further comprises extending said end of the suspension sheet over another band closely situated to said primary structural member and securing the suspension sheet relative to said another band.

13. The method of claim 12 further comprising sealing each end of the suspension sheet to the adjacent primary structural member.

14. A method of installing insulation in the roof of a building including a pair of generally parallel spaced-apart primary structural members and a roof structure including a plurality of secondary structural members extending between said primary structural members in generally parallel spaced-apart relation and a ceiling covering the space between said structural members, comprising the steps of extending a series of metal bands across the undersides of a plurality of said secondary structural members, supporting the opposite ends of said bands, providing a continuous independent suspension sheet having a width sufficient to span a plurality of said secondary structural members and a length at least slightly greater than the distance between said pair of primary structural members, positioning said suspension sheet on said bands, spreading out said suspension sheet on said bands to span a plurality of said secondary structural members, providing an elongated strip of blanket insulation having a width generally equal to the spacing between secondary structural members and a length generally equal to the spacing between said pair of primary structural members pulling said blanket insulation over and across said suspension sheet to generally span the distance between primary structural members.

15. A method of insulating a building wall including a plurality of upright spaced-apart primary structural members defining at least one wall section therebetween and upper and lower cross members extending between said primary structural members to define the vertical limits of a wall section, and a wall panel secured to and covering the exterior surfaces of said primary structural members, said method including providing a strip of insulation material of a height and width substantially corresponding to the height and width of said wall section, placing said strip of insulation material in said wall section against said wall panel whereby said strip substantially fills said wall section, providing a continuous independent flexible suspension sheet of a vapor barrier material having a width sufficient to span between a pair of said primary structural members and a height at least slightly greater than the floor to ceiling height of said wall, suspending said suspension sheet over the interior side of said insulation material, sealing the edges of said suspension sheet to the primary structural members and upper and lower cross members extending between said primary structural members.

16. The method of claim 15 further comprising extending a series of horizontal bands across the interior surface of said suspension sheet and securing said horizontal bands to said primary structural members.

17. The method of claim 15 wherein said upper and lower cross members are selected from the group consisting of the building floor, the building roof structure, and secondary structural members extended horizontally between said primary structural members.

18. The method of claim 17 further comprising extending a series of bands vertically across the interior surface of said suspension sheet and securing the opposite ends of said vertical bands adjacent the floor and roof structure respectively.

19. In a building wall structure including a plurality of upright spaced-apart primary structural members defining at least one wall section therebetween, upper and lower cross members having upper and lower edges and extending between said primary structural members to define the vertical limits of a wall section, the height of said wall section being the vertical distance between the upper edge of the upper cross member and the lower edge of the lower cross member, and a wall panel extended between and connected to said primary structural members to cover the area therebetween, a system for insulating said wall panel, comprising at least one elongated strip of insulation material of a height substantially corresponding to the height of said wall section, said at least one strip of insulation material being situated in said wall section against said wall panel whereby said at least one strip substantially fills the area of said wall section, a continuous independent flexible suspension sheet of a vapor barrier material having a width sufficient to span between a pair of said primary structural members and a height at least slightly greater than the height of said wall section, means for suspending said suspension sheet over the interior side of said insulation material, and means for sealing the edges of said suspension sheet to the primary structural members and upper and lower cross members extending between said primary structural members.

20. The system of claim 19 further comprising means for connecting an upper portion of said strip of insulation material to said upper cross member.

21. The system of claim 20 wherein said upper and lower cross members are selected from the group consisting of the building floor, the building roof structure, and secondary structural members extended horizontally between said primary structural members.

22. The system of claim 21 further comprising at least one vertical band extended vertically across the interior surface of said suspension sheet and means securing the opposite ends of said vertical band to said upper and lower cross members.

23. The system of claim 21 further comprising at least one horizontal band extended horizontally across the interior surface of said suspension sheet and means for securing the opposite ends of said horizontal band to said primary structural members.

* * * * *